US007556481B2

(12) United States Patent
Moubayed

(10) Patent No.: US 7,556,481 B2
(45) Date of Patent: Jul. 7, 2009

(54) ROTARY AXIAL PERISTALTIC PUMPS AND RELATED METHODS

(75) Inventor: Ahmad-Maher Moubayed, Mission Viejo, CA (US)

(73) Assignees: Baxter International Inc., Deerfield, IL (US); Baxter Healthcare S.A., Wallisellen (CH)

( * ) Notice: Subject to any disclaimer, the term of this patent is extended or adjusted under 35 U.S.C. 154(b) by 495 days.

(21) Appl. No.: 11/212,931

(22) Filed: Aug. 26, 2005

(65) Prior Publication Data

US 2007/0048161 A1 Mar. 1, 2007

(51) Int. Cl.
*F04B 45/08* (2006.01)

(52) U.S. Cl. ..... 417/477.3; 417/477.1; 417/477.2; 417/477.7; 417/477.6; 417/477.9

(58) Field of Classification Search ..... 417/474, 417/475, 476, 477.1–477.14
See application file for complete search history.

(56) References Cited

U.S. PATENT DOCUMENTS

| | | | | |
|---|---|---|---|---|
| 1,933,081 | A * | 10/1933 | Stephan | 417/269 |
| 2,877,714 | A | 3/1959 | Sorg et al. | |
| 3,172,367 | A | 3/1965 | Kling | |
| 3,901,565 | A | 8/1975 | Hagen et al. | |
| 4,004,377 | A * | 1/1977 | Laudick | 451/394 |
| 4,626,940 | A * | 12/1986 | Kobayashi | 360/96.3 |
| 4,671,792 | A | 6/1987 | Borsanyi | |
| 4,728,265 | A | 3/1988 | Cannon | |
| 4,753,581 | A * | 6/1988 | Hiscock | 417/539 |
| 4,886,431 | A | 12/1989 | Soderquist et al. | |
| 4,893,991 | A | 1/1990 | Heminway et al. | |
| 5,551,850 | A | 9/1996 | Williamson et al. | |
| 5,626,563 | A * | 5/1997 | Dodge et al. | 604/153 |
| 5,733,105 | A * | 3/1998 | Beckett et al. | 417/269 |
| 5,791,881 | A | 8/1998 | Moubayed et al. | |
| 5,924,852 | A * | 7/1999 | Moubayed et al. | 417/474 |
| 6,036,459 | A | 3/2000 | Robinson | |
| 6,371,732 | B1 | 4/2002 | Moubayed et al. | |
| 6,547,441 | B2 | 4/2003 | Kato | |
| 2004/0209724 | A1 | 10/2004 | Ai et al. | |
| 2005/0025647 | A1 * | 2/2005 | Ortega et al. | 417/477.1 |

FOREIGN PATENT DOCUMENTS

| | | |
|---|---|---|
| DE | 2152352 | 4/1973 |
| IT | 582797 | 9/1958 |
| WO | WO 9729285 A1 * | 9/1997 |

OTHER PUBLICATIONS

International Preliminary Report on Patentability (IPRP) for PCT/US2006/033609, mailed Dec. 11, 2008.
PCT Search Report for WO2007/025268 A3 dated Jan. 8, 2009.

* cited by examiner

*Primary Examiner*—Devon C Kramer
*Assistant Examiner*—Christopher Bobish
(74) *Attorney, Agent, or Firm*—Austin J. Foley; K&L Gates LLC

(57) ABSTRACT

Rotary axial peristaltic pumps, related methods and components. The rotary axial peristaltic pump generally comprises a platen having a platen surface, a tube positioned adjacent to the platen surface, cam that rotates about a rotational axis and has a cam surface that is spaced apart from the platen surface and a plurality of tube compressing fingers. The fingers move axially back and forth in sequence to sequentially compress segments or regions of the tube against the platen surface, thereby causing peristaltic movement of fluid through the tube. The fingers move back and forth on axes that are substantially parallel to the axis about which the cam rotates.

23 Claims, 12 Drawing Sheets

ROTARY AXIAL PERISTALTIC PUMPS AND RELATED METHODS

FIELD OF THE INVENTION

This invention relates generally to pumps and related methods and more specifically to peristaltic pumps and methods for pumping fluids that are useful in a variety of medical and non-medical applications.

BACKGROUND OF THE INVENTION

Peristaltic pumps are devices that transfer fluid through one or more elongate, at least partially flexible, tube(s) by compressing each tube in a peristaltic manner. Fluid transport through the tube is effectuated by moving a region of compression along the length of the tube. Such movement of the region of compression is typically achieved by way of one or more rollers or reciprocating pushers that progressively move an area of compression along the length of the tubing to thereby pump fluid through the tubing in a peristaltic motion. Such pumps are often used in medical applications including intravenous or subcutaneous infusion, withdrawal of fluids as in wound drainage systems as well as various laboratory instruments and industrial applications, such as industrial applications where toxic or corrosive fluids are pumped.

Typical linear peristaltic pumps include those described in U.S. Pat. No. 2,877,714 (Sorg et al.), U.S. Pat. No. 4,671,792 (Borsannyi), U.S. Pat. No. 4,893,991 (Hemingway et al.) and U.S. Pat. No. 4,728,265 (Canon), the entire disclosures of which are expressly incorporated herein by reference. In general, these pumps require a drive shaft that is parallel to a resilient tube and a plurality of cams along the drive shaft to move pushers toward and away from the tube.

Rotary peristaltic pumps generally dispose a resilient tube along a circular path, with a number of rollers mounted around the circumference of a circular rotor-sequentially rolling along the tube to occlude the tube and force liquid through the tube. Typical of such pumps are those disclosed in U.S. Pat. No. 4,886,431 (Soderquist et al.) and U.S. Pat. No. 3,172,367 (King), the entire disclosures of which are expressly incorporated herein by reference. These pumps often have relatively low efficiency and impose high shear and tension stresses on the tube causing internal tube wall erosion or spallation. The tube may eventually be permanently deformed so that the tube becomes flattened into a more oval shape and carries less liquid.

The prior art has also included another type of peristaltic pump wherein a tube is arranged along a circular path and a cylindrical cam that rotates eccentrically is used to sequentially move a plurality of blunt pushers or fingers to sequentially compress regions of the tube from one end of the path to another and of the path. Examples of such pumps are described in German Patent No. 2,152,352 (Goner) and Italian Patent No. 582,797 (Tubospir), the entire disclosures of which are expressly incorporated herein by reference. In general, these "finger" type peristaltic pumps tend to be less complex than linear peristaltic pumps. However, the pressure exerted by the blunt fingers on the tubing can reduce the useable life of the tubing and can, in at least some cases, cause internal tube wall erosion or spallation resulting in possible loss of particulate matter from the tube wall into the fluid stream. Also, in at least some cases, tubes with different wall thicknesses may not be accommodated by these pumps, since with thinner than standard tubes the fingers will not properly occlude the tube and with thicker than standard tubes the tube will close prematurely and be subject to excessive compression, requiring higher cam drive power and causing excessive wear on the cam and tube.

In many applications of peristaltic pumps, in particular medical applications, it is important to promptly detect when the pump ceases to operate due to an occlusion in the pump tube either before or after the pump. In other applications, it is equally important to monitor the pressure in the tubing. An input occlusion occurring in the tube leading to the pump will cause the tube to collapse due to the fluid being sucked from the input side and pushed out the output side. An output occlusion occurring in the tube leading away from the pump will continue to push liquid into the output tube, inflating the tube and possibly causing it to burst. In either case, fluid flow to the end use is stopped or reduced.

One type of peristaltic pump that is especially effective is the curvilinear peristaltic pump described in U.S. Pat. No. 5,791,881 (Moubayed et al.), the entire disclosure of which is incorporated herein by reference. In the pump described in U.S. Pat. No. 5,791,881, a resilient tube is disposed against a generally circular platen and a rotating cam member sequentially and radially moves a plurality of fingers such that the fingers compress the tube and force the fluid through the tube in a peristaltic fashion. In this curvilinear peristaltic pump of the prior art, the cam drives the pump fingers in a radial direction. Because the pump fingers extend in a radial direction from the curved cam surface, the pump must be large enough (in the radial direction) to accommodate the outer radial length of the cam, the height of the pump fingers and the thickness of the concave curved platen.

There remains a need in the art for the development of new peristaltic pumps that provide advantages and/or useful improvements or differences over those of the prior art.

SUMMARY OF THE INVENTION

Accordingly, the present invention provides peristaltic pump devices (sometimes referred to herein as "rotary axial peristaltic pumps") and methods which provide advantages and/or useful improvements or differences over the peristaltic pumps of the prior art. In at least some embodiments of the present invention, there are provided rotary axial peristaltic pumps that provide smooth fluid delivery, low drive torque power requirements, and/or less complexity than the conventional peristaltic pumps of the prior art.

In accordance with one embodiment, a peristaltic pump device is provided which generally comprises a platen assembly including a platen surface, a cam having a rotational axis and a cam surface spaced apart from the platen surface. In addition, the device comprises a plurality of fingers having a first portion in cooperative engagement with the cam surface and a second portion adjacent the platen surface and structured to engage and compress a tubing disposed along the platen surface. The device may further include a housing containing the cam and fingers.

Further in accordance with this invention, the platen assembly, cam and fingers may be operatively configured such that, when the cam is rotated about its rotational axis, the second portions of the fingers will reciprocate in a direction that is substantially parallel to the rotational axis of the cam, such that when a fluid filled compressible tubing is disposed along the platen surface, the reciprocating motion of the second portions of the fingers will effect pumping of the fluid through the tubing.

Still further in accordance with this invention, in some embodiments, the platen may comprise a substantially planar surface that is configured to receive a portion of compressible tubing parallel thereto. In some embodiments, the platen assembly may include one or more tube holding member(s) (e.g., clips, ribs, notches, magnets, grooves, recesses, etc.) that hold or retain the compressible tubing in a desire position or configuration between the platen surface and the second portions of the fingers. For example, in some embodiments, the tube holding member(s) may comprise a plurality of spaced apart rib members, extending from the platen surface and including features, for example, cut out regions, for receiving and securing a tubing in an appropriate position along the platen surface.

Still further in accordance with this invention, in some embodiments, the platen assembly may comprise a door that is hingedly or pivotally connected to the housing, wherein such door includes the platen surface on an interior surface thereof. In embodiments that include such door, the door may be structured to facilitate installation and removal of the tubing, and maintenance of the device by allowing easy access to the tubing carrier as well as the fingers and/or other components of the system.

Still further in accordance with this invention, the fingers of the pump may reciprocate back and forth on longitudinal axes that are generally perpendicular to the cam surface and generally parallel to an axis of rotation about which the cam rotates. Generally, as the cam assembly is rotated about the axis of rotation, elevations or lobes on the cam may cause the fingers to move in a direction substantially parallel to the cam rotational axis. More specifically, the cam surface may be described as including a path, or a cam race on which the first portions of the fingers ride as the cam moves. The fingers may be aligned along a path defined by the cam race. The cam race is preferably located on a peripheral region of the cam, such cam race having one or more race surface(s) upon which the fingers ride. An axial plane may be projectable through the race surface(s), such axial plane being substantially perpendicular to the axis of rotation about which the cam rotates. The cam race includes elevated regions or lobes which, when the cam is rotated about the rotational axis, cause the second portions of the fingers to move back and forth along their longitudinal axes, thereby sequentially compressing and decompressing the tubing to effect pumping of fluid through the tubing.

Still further in accordance with this invention, in some embodiments, the first ends of the fingers may include moving members, for example rollers mounted on or within first ends of the fingers. These moving members (e.g., rollers) may contact and roll or otherwise move along the cam race as the cam surface moves along the rotational path. In some embodiments, these rollers may be substantially spherical. Also, in some embodiments, the cam surface may include a substantially concave race. Such concave race may be configured such that the radius of the race is larger than the radius of the rollers. Thus, in effect, each of the rollers will contact the cam race at a "point" or limited area of contact. In other embodiments, the race may comprise a groove or depression such that each of the rollers will contact opposing locations on the opposite side walls of the groove or depression. In still other embodiments, the race may comprise a tapered groove and the rollers may be correspondingly tapered so as to ride on a tapered wall of the race. In still other embodiments, the race may comprise a raised area or rail and the rollers may be correspondingly configured so as to ride on such raised area or rail. In still other embodiments, the race may comprise a wavy or curved cam surface and the rollers may be maintained in positions that cause the rollers to ride on such wavy or curved surface.

Still further in accordance with this invention, in some embodiments, the pump may incorporate spring(s) or other biasing apparatus for actively retracting the fingers after they have compressed the tubing as intended, without requiring the fingers to be linked to the cam in such a way as to cause the cam to actively pull the fingers away from the tubing. More specifically, the fingers may interact with spring(s) or other biasing apparatus that cause retraction of the second end of each finger in a direction away from the platen surface after that finger has caused the desired compression of the tubing. Additionally or alternatively, the fingers may interact with spring(s) or other biasing apparatus that substantially maintain the fingers in operative engagement with the cam surface. Such spring(s) or other biasing apparatus may be structured to allow for a more precise degree of control over the operation of the fingers, and more precise control over pumping overall, relative to prior art devices which rely on resiliency or springiness of the tubing to cause retraction of pump fingers and/or which require the fingers to be coupled to the cam such that the cam not only pushes each finger to compress the tubing but also pulls each finger to cause it to retract away from the tubing.

Still further in accordance with this invention, in some embodiments, tip members may be located on the ends of some or all of the pump fingers. Such tip members may be spring biased or otherwise biased to provide a controlled amount of compressive force on the tubing such that the lumen of the tubing will be fully occluded or "pinched off" when the finger reaches its point of maximum travel but the compressive force on the tubing will not be so strong as to cause unnecessary stress or wear on the tubing. In at least some embodiments, the tip members will be narrower than the width of the compression surface of the finger. Such tip members may be shaped to provide for a discrete occlusion zone that extends transversely across the tubing when the finger reaches its point of maximum travel.

Still further in accordance with this invention, the pump device may optionally include a strain gauge transducer or other apparatus that provides an indication of the degree or amount of deflection, expansion or contraction of the tubing as fluid is being pumped through the tubing.

These and other aspects and advantages of the present invention are apparent in the following detailed description and claims, particularly when considered in conjunction with the following drawings in which like parts are identified by like reference numerals.

DETAILED DESCRIPTION OF THE INVENTION

The following detailed description and the accompanying drawings are intended to describe some, but not necessarily all, examples or embodiments of the invention. The contents of this detailed description and the accompanying drawings are not necessarily all-inclusive and do not limit the scope of the invention in any way.

Figure 1:
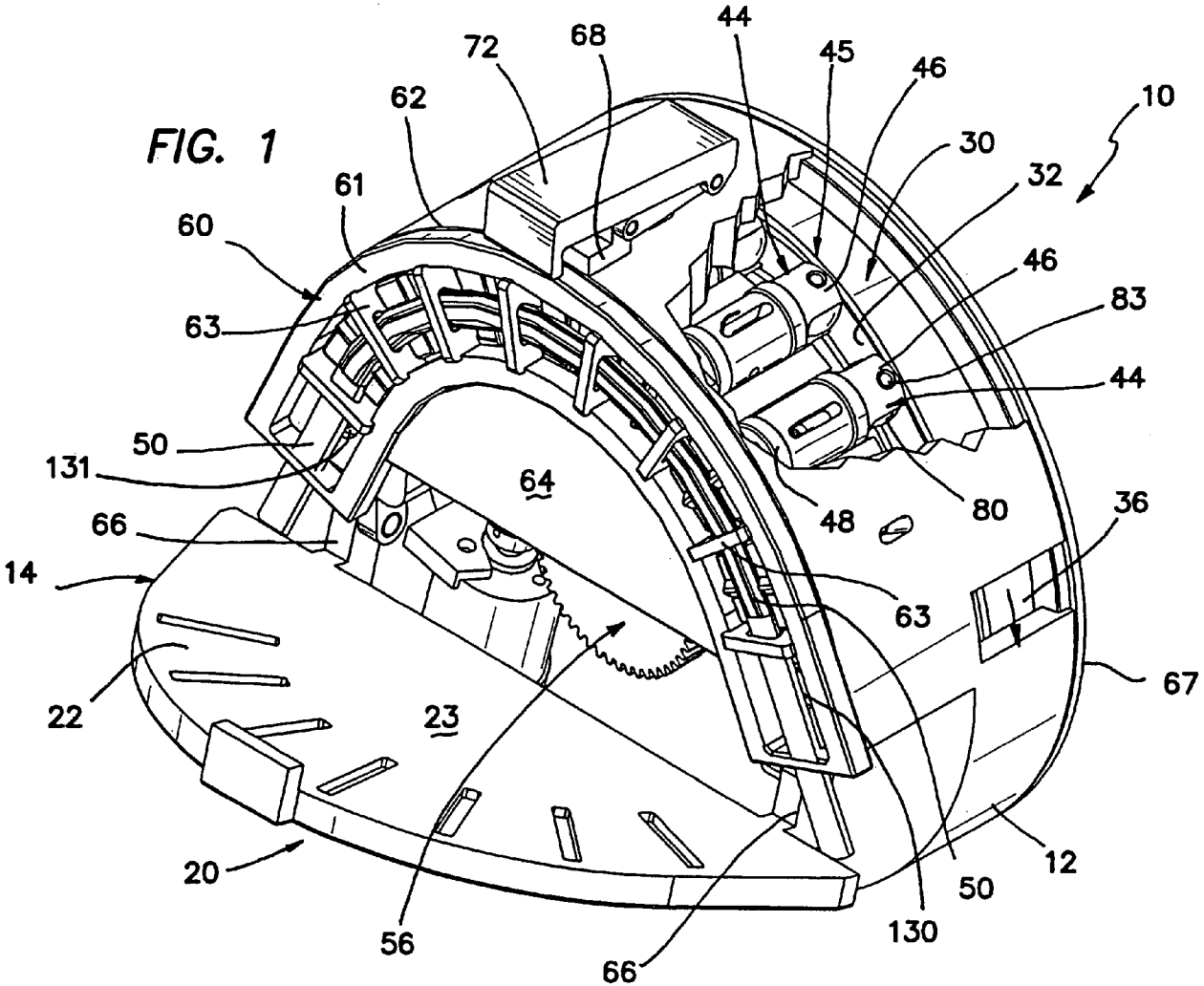
FIG. 1 is a perspective view of an embodiment of a rotary axial peristaltic pump device of the present invention with a housing partly cut-away, the device including a cassette tubing carrier installed to the housing and a hinged platen door being open.
Figure 2:
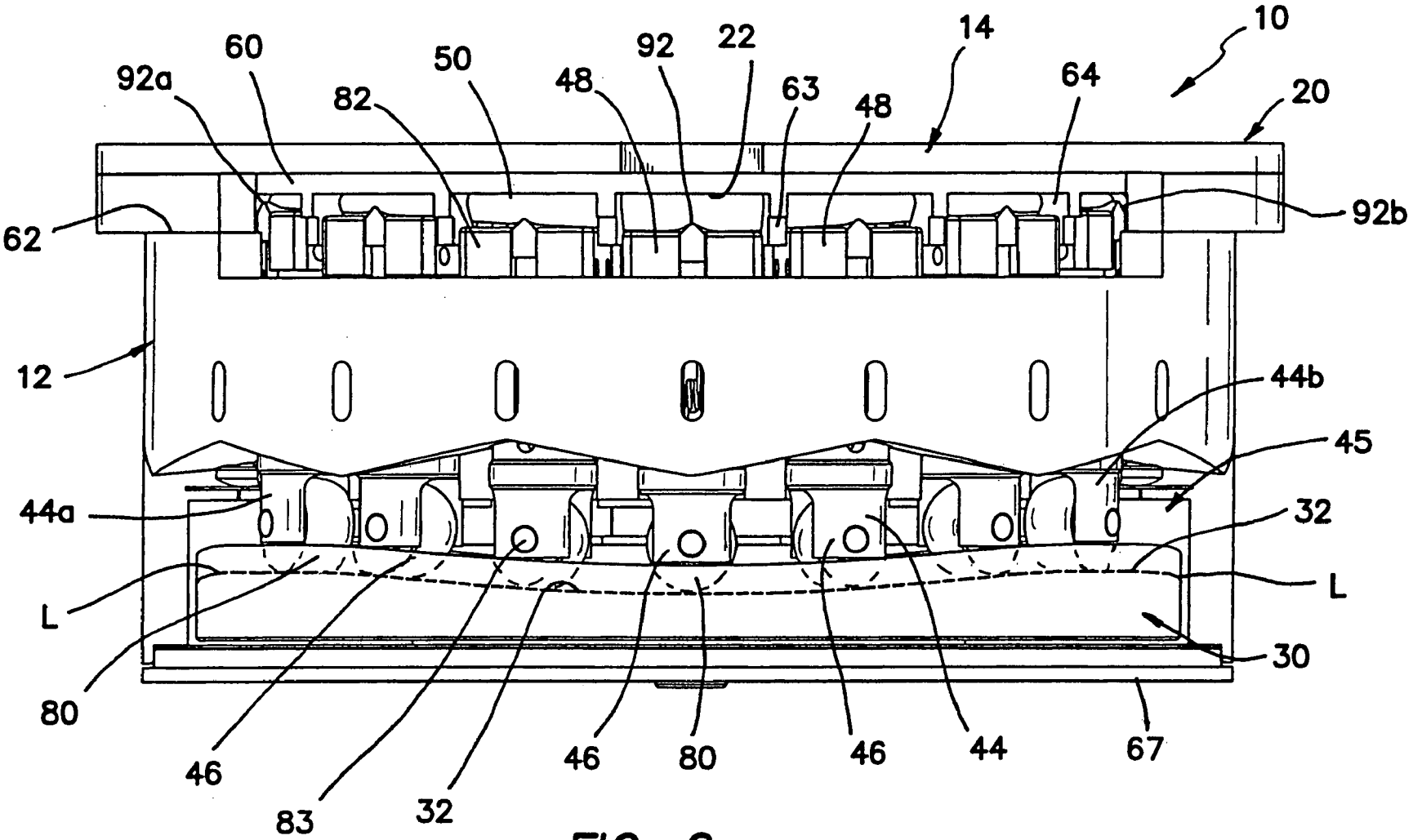
FIG. 2 is an end elevational view of the device shown in FIG. 1 with the housing partially cut away and the platen door being in a closed or operational position (latch and stop assembly omitted for purposes of clarity).

FIGS. 1 and 2 show one embodiment of a rotary axial peristaltic pump device 10 of the present invention. In FIG. 1, the device 10 is shown in an "open" configuration for purposes of illustrating internal components of the device 10 more clearly. FIG. 2 provides an end view of the same device 10 in a "closed" or operational configuration.

The device 10 shown in FIGS. 1 and 2 generally comprises a housing 12 with a platen door 14 hingedly engaged thereto. The platen door 14 forms a part of a platen assembly 20 which includes a platen surface 22. Preferably, the platen surface 22 comprises a substantially planar or substantially flat platen surface 22. This platen surface 22 may comprise, or may be positioned on, at least a peripheral region of the interior surface 23 of the platen door 14. This device 10 further comprises a cam 30 that rotates about an axis of rotation AR and has a cam surface 32 that is spaced apart from the platen surface 22 when the platen door 14 is in the closed position, such as that shown in FIG. 2. As may be appreciated from the showing of FIG. 1, the cam 30 may rotate about the axis of rotation AR in a direction, such as that indicated by arrow 36. It is to be understood, however, that rotation of the cam 30 in the direction opposite arrow 36 is also possible.

The device 10 shown in FIGS. 1 and 2 further comprises a plurality of fingers 44 which may form a finger assembly 45 mounted within the housing 12. The fingers 44 are aligned in a substantially accurate array, one next to another, and substantially parallel (e.g., within approximate 10 degrees of parallel) to one another. The fingers 44 are aligned such that a longitudinal axis LA of each finger 44 is substantially parallel to the axis of rotation AR of the cam 30.

Referring now specifically to FIG. 2, each finger 44 may include a first portion 46 and a second portion 48. When the device 10 is in use, the first portion 46 is in cooperative engagement with the cam surface 32 and the second portion 48 is adjacent the platen surface 22. A tubing element 50, such as a flexible tube formed of suitable material (e.g., polyvinyl chloride (PVC), silicon, latex, polyurethane, etc.) is disposed between the second portions 48 of the fingers 44 and the platen surface 22.

Figure 6A:
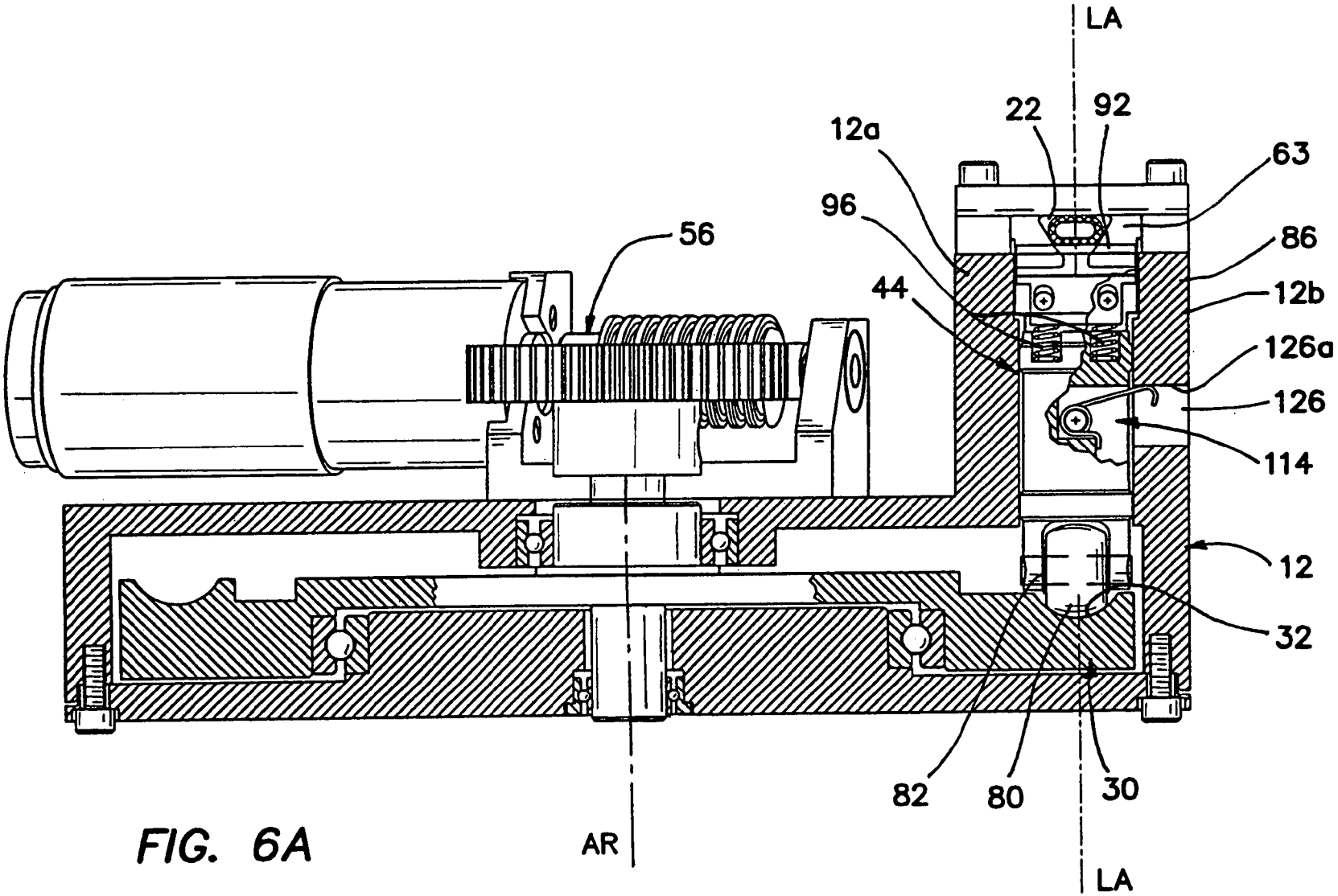
FIG. 6A is a cross-sectional, partially cut-away view of the a portion of the device, showing a finger in a retracted position.
Figure 6B:
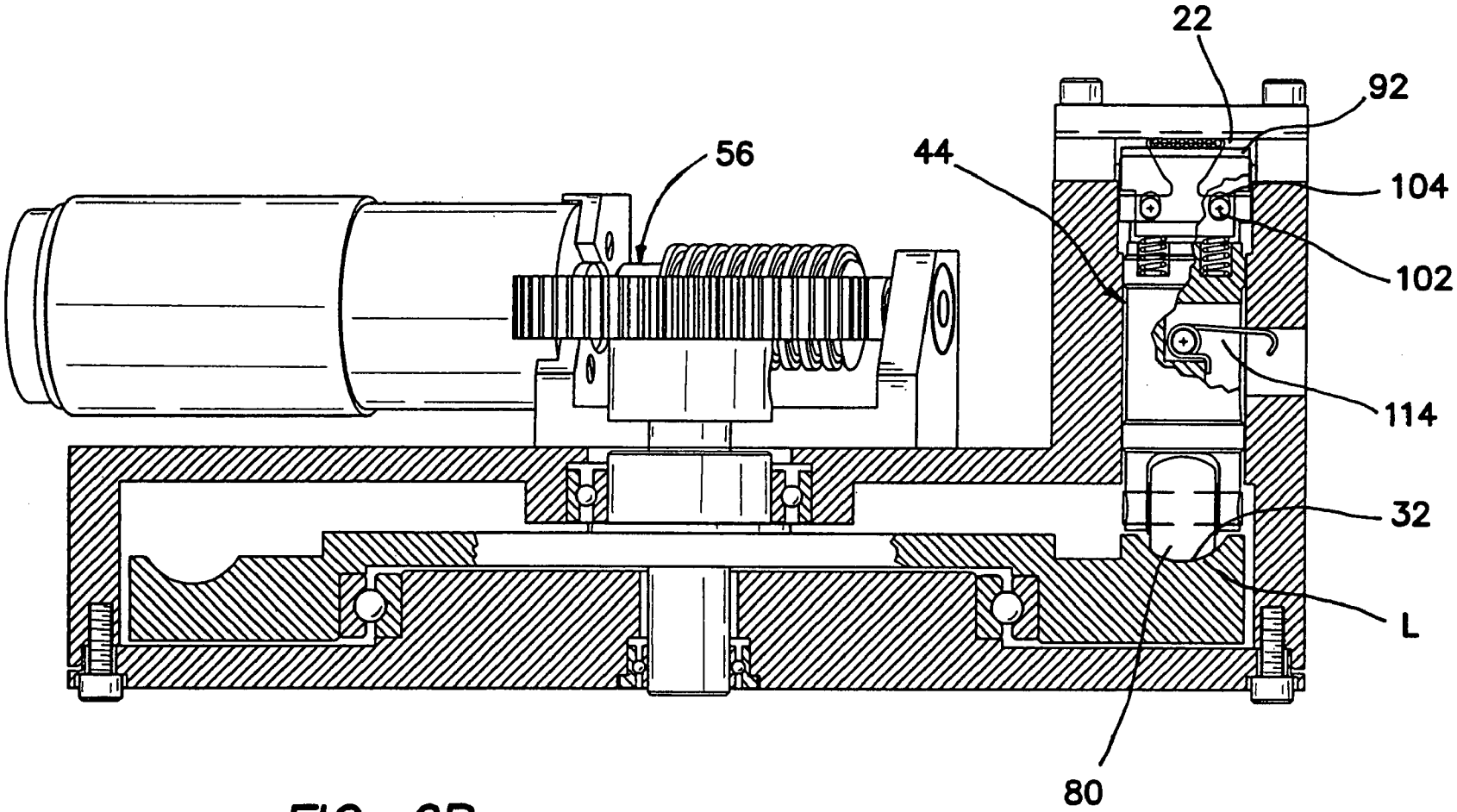
FIG. 6B is a cross-sectional, partially cut-away view of the a portion of the device, substantially identical to FIG. 6A but showing the finger in a compressing position.

The cam 30 is rotatable about the axis of rotation AR by suitable means such as a motor driven gear mechanism 56 (shown in FIGS. 6A and 6B). In this example, the device 10 is structured such that when the device 10 is in the closed or operational configuration and the cam 30 is rotated about the axis of rotation AR, the second portions 48 of the fingers 44 will reciprocate back an forth in the direction of their longitudinal axes LA, in other words, each finger 44 reciprocates back and forth on a longitudinal axis LA that is substantially parallel (e.g., within approximately 10 degrees of parallel) to the axis of rotation AR of the cam 30.

Figure 3:
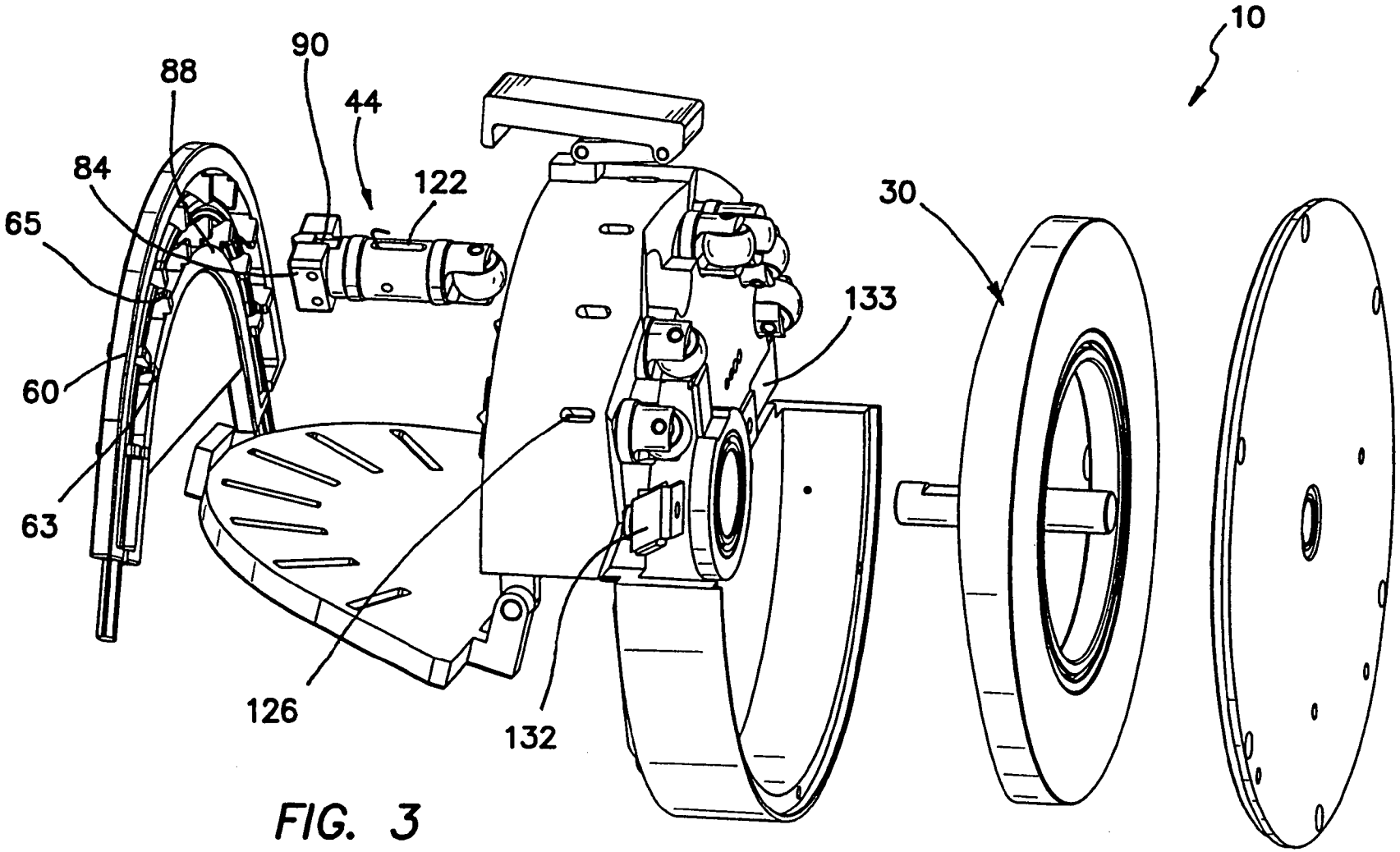
FIG. 3 is a somewhat exploded perspective view of the pump device shown in FIG. 1, illustrating the alignment of various components of the system.

As shown in dashed lines on FIG. 2, the cam surface 32 may include regions having contours defining varying elevation of cam surface 32, such as lobes L. The contours of cam surface 32 effects a wave like, or peristaltic motion of the fingers 44 as the cam surface 32 travels beneath the first ends of the fingers 44. It will be appreciated that, in at least some embodiments, the greater the rate of change of the slope of the cam lobes L the more power required to operate the pump. Because the pump of the present invention may employ pump fingers whose longitudinal axis is substantially parallel to the axis of cam rotation, the circumference of the cam can extend nearly to the extent of the pump housing. A cam race that is located near the circumference of the cam thereby achieves a maximum cam race length without increasing the size of the envelope of the mechanism. Where the cam race length is substantially long compared to rise and fall of the cam lobes a small rate of change of the slope of the cam lobes is achieved thereby enabling pumps of the present invention to proved the same or greater pumping efficiency with less power consumption. In embodiments that are battery powered, this improved pumping efficiency may result in longer battery life. Additionally, because the pumps of this invention may utilize cams that rotate about an axis of rotation AR that is substantially parallel to the longitudinal axes LA of the fingers 44, such pumps of the present invention may be smaller in size than prior art peristaltic pumps of similar pumping capacity. As shown in FIGS. 1 and 3, the tubing element 50 may optionally be disposed on or in a tube cassette 60 and such cassette 60 may be located within the housing 12. The tube cassette 60 may be any suitable type of structure(s) or apparatus (e.g., frame, lattice, scaffold, series of clips, series of ribs, etc.) that when installed within the housing 12 will hold the tubing element 50 in a substantially fixed position or shape. Cassette 60 may comprise a frame 61 having a plurality of transverse members such as ribs 63 with notches 65 formed therein such that the tubing element 50 is received and held within the notches 65. It will be appreciated that instead of the particular cassette 60 shown in this example, various other material/apparatus, such as adhesive, clips, clamps, notches, hooks, etc., may be used to hold or otherwise secure the tubing element 50 in a desired position or shape within the device. Stabilizing elements, for example, web section 64 may be included on the cassette 60 for providing strength and stability thereto. In some embodiments, ribs 63 may be sized and positioned to fit between the second portions 48 of adjacent fingers 44. This is shown, for example, in FIG. 2. In some embodiments the ribs 63 may be sized and positioned to facilitate alignment of the cassette tubing carrier 60 when the tubing carrier 60 is installed to the front housing surface 62. This may be accomplished by designing the ribs 63 such that they seat, engage or register with specific depressions, indentations, apertures or surfaces of the device thereby ensuring that the ribs 63, and thus the tubing element 50, are in a desire shape and/or a desire position (e.g., desired alignment) relative to the fingers 44.

In some embodiments, the tubing may be pre-mounted on or in the cassette 60, thereby eliminating the need for manual handling and mounting of the tubing element 50 within the pump device 10. Additionally or alternatively, the shape of the notches 65, or other cut away regions through which the tubing element 50 passes, may be of generally triangular shape or may be otherwise shaped so as to assist or facilitate rebounding of the tubing element 50 to its fully, or near fully, expanded, non-compressed shape after it has been compressed by each finger 44. Such notches 65 or other suitable tube-constraining or tube-contacting structures provide partial compression or resistance to expansion of the tubing element 50 in a direction that is generally perpendicular to the direction in which the finger 44 compresses the tubing element 50, thereby countering the compressive effect on the tubing element 50 and facilitating rapid re-expansion of the tubing element 50 as the finger 44 is withdrawn away from the tubing element 50.

Additionally or alternatively, in some embodiments, the cassette 60 may include a tag, barcode, sensor, switch, triggering mechanism, identifying protrusion(s), machine readable element(s) or other apparatus/material that will enable a sensing (e.g., detecting) component of the pump device 10 (e.g., a sensor that is in communication with a computer, controller or other processor) to identify a particular cassette 60, or a particular size/type of cassette 60, or to identify the presence or absence of the cassette 60 and, optionally, to disable the pump device 10 or provide an alarm (e.g., audible alarm, light, etc) or other signal when the cassette 60 is absent, improperly positioned or of an incorrect size/type, etc.

As seen in FIG. 1, the housing 12 may include a back support plate 67 held together by plurality of bolts for ease of assembly and disassembly as needed. The housing 12 supports the hinged platen door 14 which pivots about hinge pins 66 coupling the door 14 to the housing 12. When in the closed position, the door 14 rests against a cover stop 68, and a latch 72 hooks over the door 14 securing the door 14 in the closed position.

In the closed position, such as shown in FIG. 2, the door 14 provides a substantially flat or substantially planar platen surface for compression of the resilient tubing 50 held in the cassette tubing carrier 60. The door 14 may be opened and released by lifting the latch 72. When not latched in the closed position, the door 14 is free to swing to a fully open position as illustrated in FIG. 1. It is to be appreciated that other arrangements are also possible for effectively and conveniently securing the platen assembly to the cam and plurality of fingers in a functional manner, and such arrangements are considered to be within the scope of the present invention.

As illustrated in FIG. 1 and FIG. 2, the housing 12 substantially encapsulates or contains the plurality of fingers 44. Each of the fingers 44 is oriented in an axial direction with respect to the rotation of the cam 30. In some embodiments, the fingers 44 are positioned within in individual housing cavities, for example defined by interior walls of the housing 12 located near the circumference thereof. For example, as seen in the exploded view of FIG. 3, the individual housing cavities may comprise a plurality of hollow cavities or chambers having finger-guiding surfaces 86 oriented axially with respect to the cam rotational axis. In other embodiments of the invention, a single housing cavity may be provided which substantially encapsulates two more of the fingers 44, for example all of fingers 44, within the housing 12.

The first portions 46 of the fingers 44 may include a moving element, for example a roller 80 which rides upon a surface of the cam 30. In some embodiments, a race 32, such as a groove, depression, track, etc., is formed in the cam 30 and the rollers 80 ride within such race 32. In the example shown, the rollers are secured to the fingers 44 by axles 82 about which the rollers 80 rotate. Alternatively, as in embodiments where the rollers 80 are substantially spherical, the rollers may be disposed and retained within recesses on the ends of the fingers 44 without being centered on an axle, so as to freely roll in all directions in a fashion similar to the ball of a ballpoint pen.

In the embodiments shown in FIGS. 1-3 and 7-8, the fingers 44 are positioned in an array, one next to another, and are constructed with lateral cuiding surfaces 86 which maintain positioning of the fingers 44 over the cam race 32. In some embodiments of the invention, the first and last pump fingers 44 in the array may be generally in alignment with the peaks of successive cam lobes. The number of fingers 44 may vary, for example, from about 3 fingers to about 50 fingers or more depending upon the desired application, desired degree of pump precision and/or other considerations that will be known to those of skill in the art.

The second portion 48 of each finger 44 includes a head portion 84 which at least partially extends beyond the housing front surface 62 and contacts tubing 50 held in the cassette tubing carrier 60.

Figure 4:
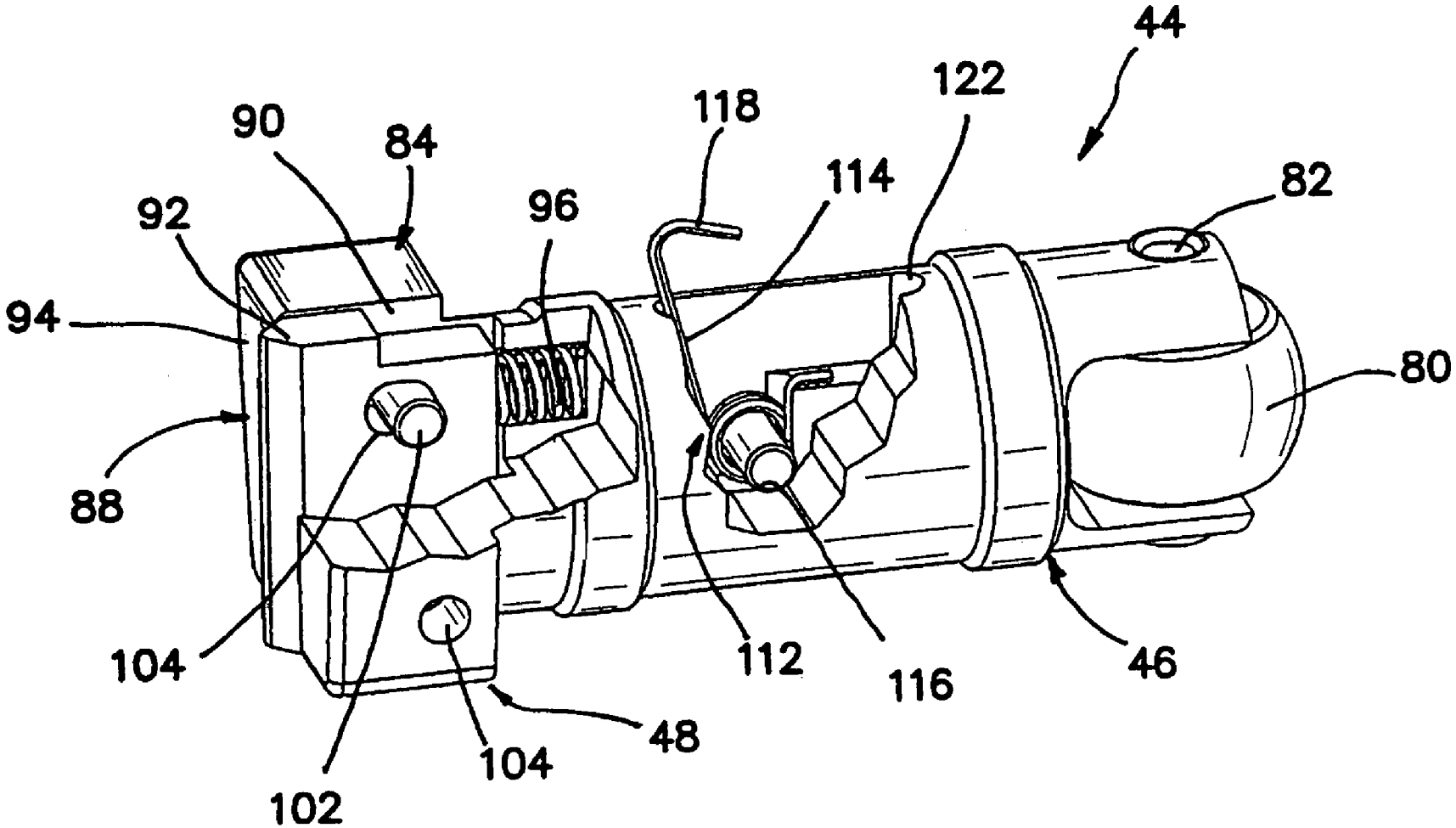
FIG. 4 is a partially cut-away perspective view of a finger in accordance with an aspect of the invention, the finger including a movable biased occlusion valve element.

In order to more clearly understand various aspect of the present invention, reference is made to FIGS. 3 and 4, which show, respectively, the device 10 in a somewhat exploded perspective view with one finger 44 pulled away from axial cam 30, and a cut-away perspective view of an individual finger 44 having various advantageous features.

The pump finger 44, in accordance with one aspect of the invention, may include a tube occluder surface 88, such as a leading edge or tip member, that fully compresses the tube 50 such that the lumen of the tube 50 becomes fully closed or pinched off when the finger 44 is at or beyond a desired amount of forward advancement (e.g., when the finger 44 is within a certain distance of its maximum forward travel). For example, in the embodiment shown, finger 44 incorporates a transverse slot 90 through which a spring-biased occlusion element 92 extends slightly beyond a compression surface 94 of the head portion 84 of the finger 44. Occlusion element 92 is shown substantially centrally located within head portion 82 but other locations may also be suitable. For example, in some embodiments the occlusion elements 92 may be located off-center, or near or at peripheral regions or ends of the compression surfaces 94. Occlusion element spring 96 functions to bias the occlusion element 92 to an extended position. Extension of the occlusion element 92 may be limited by occlusion element guide pins 102 disposed in or associated with apertures 104. In the example shown in the drawings, the occlusion element 92 is positioned midway between opposite ends of the compression surface 94 such that on each finger 44 portions of the compression surface 94 are located on either side of the occlusion element 92. It will be appreciated, however, that in some embodiments the occlusion elements 92 may be positioned at locations other than midway between the ends of the compression surface 94.

Figure 5:
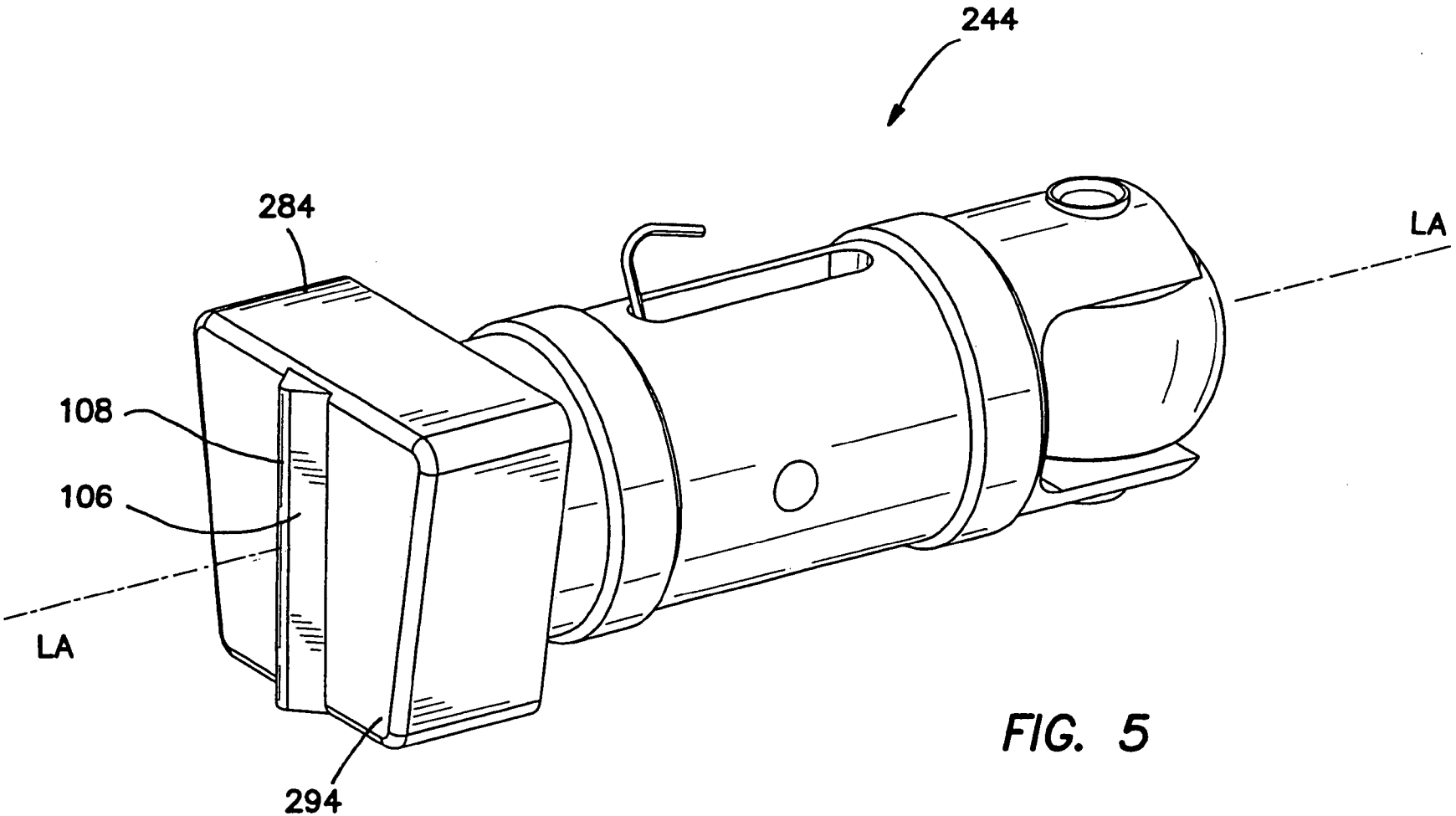
FIG. 5 is a perspective view of an alternative finger useful in the device of the invention.

Turning to FIG. 5, an alternative finger 244 is shown. Finger 244 is substantially the same as finger 44, with an exception being that finger 244 does not have a movable, or spring biased occlusion element 92, but instead has a protrusion, for example, a ridge portion 106 with a surface 108 located distally of compression surface 294. In this embodiment, ridge portion 106 is incorporated into the head 284 of the finger 244. Like movable occlusion element 92, fixed element 108 may be located at or near a periphery of the compression surface 294 rather than substantially centrally as shown. Ridge portion 106 functions to provide a focused region of occlusion as head 284 presses against tubing during operation of the device 10.

Referring back now to FIG. 4, the finger 44 may further include a retraction mechanism 112 for biasing the second portion 48 of the finger 44 away from the platen surface 22. The retraction mechanism 112 may comprise a retraction spring 114 mounted in the pump finger 44 and held in position by positioning pin 116. A hooked end 118 of the retraction spring 114, extending outwardly from aperture 122, as shown for example in FIG. 3, engages a housing aperture 126 when the finger 44 is installed into the device housing 12.

The pump device 10 operates in the following manner. Referring to FIG. 2, the direction of rotation of the cam 30 in the pumping action causes fluid to flow from the left to the right. Pump fingers 44 have their rollers 80 cooperatively engaged with the cam surface 32. Due to position of cam lobes L, the first finger and last finger, 44*a* and 44*b* respectively, are fully extended with the fingers 44 in between being progressively retracted as controlled by contours of the cam surface 32. The occlusion valve elements 92*a* and 92*b* of the first and last pump fingers 44*a* and 44*b*, operate to occlude a section of tubing 50 creating a captured volume of fluid between the first pump finger 44*a* and last pump finger 44*b*.

As the cam 30 rotates moving the left cam lobe to the right, the second left pump finger further extends to compress and occlude the tubing above it while at the same time the last finger retracts and removes the tubing occlusion above it. Fluid in the tube 50 now starts to flow to the right past the last pump finger. In addition, fluid from the inlet side of the tubing 50 begins to fill the tubing section behind (from the left) of the second left pump finger. As the left cam lobe continues to move to the right, subsequent pumping fingers progressively continue to compress and occlude the tubing above them thus causing the fluid in the tubing to flow to the right and fill from the left. In as much as the cam has a plurality of cam lobes, when the left lobe finally arrives under the last pump finger (right most), another cam lobe arrives under the first pump finger capturing a new volume of fluid between the first and last pump fingers 44.

Figure 4C:
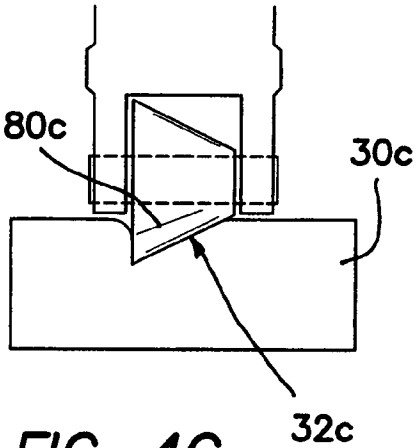
FIG. 4C is a diagram of another embodiment of a cam/finger assembly of a pumping device of the present invention wherein the finger has a substantially tapered roller surface that rides in a substantially tapered cam race.
Figure 4B:
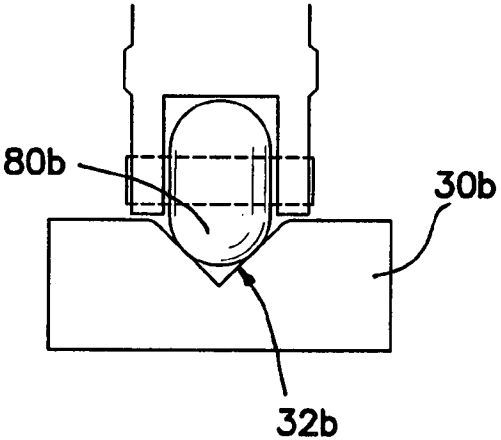
FIG. 4B is a diagram of another embodiment of a cam/finger assembly of a pumping device of the present invention wherein the finger has a substantially spherical roller surface that rides in a substantially V shaped cam race.
Figure 4A:
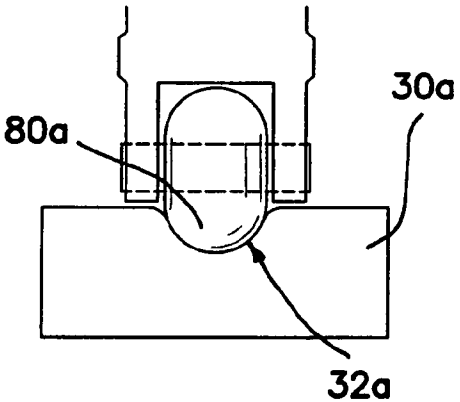
FIG. 4A is a diagram of one embodiment of a cam/finger assembly of a pumping device of the present invention wherein the finger has a substantially spherical roller surface that rides in a substantially accurate cam race surface.
Figure 4E:
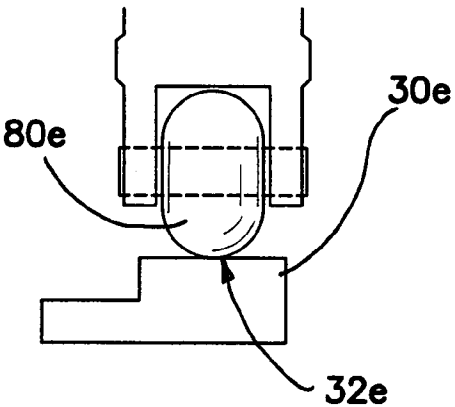
FIG. 4E is a diagram of another embodiment of a cam/finger assembly of a pumping device of the present invention wherein the finger has a roller surface that rides on a cam race surface that is substantially flat when viewed in cross section.
Figure 4D:
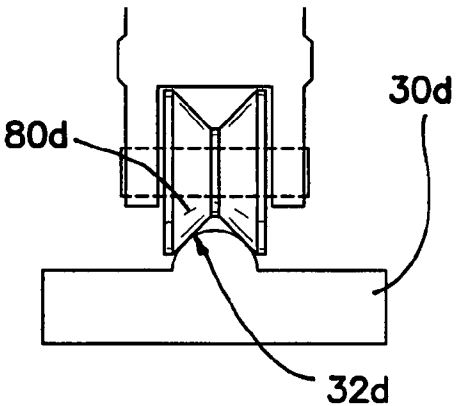
FIG. 4D is a diagram of another embodiment of a cam/finger assembly of a pumping device of the present invention wherein the finger has a roller whose surface has a generally V-shaped indentation that rides on a substantially raised cam race surface

Rollers 80 or other moveable members on the fingers 44 may roll, rotate ride or otherwise ride or track through a cam surface 32 that comprises a race, such as a groove or depression. The shape of the roller 80 or other moveable element may correspond to the shape of the cam surface race 32 to provide for firm tracking and minimal wear of the rollers 44. FIGS. 4A-4E show several non-limiting examples of this concept. In FIG. 4A, the cam 30*a* has a race surface 32*a* that is substantially accurate and the rollers 80*a* on the fingers 44 are substantially spherical and or corresponding size such that they seat and roll firmly on the accurate race surface 32*a*, as shown. In FIG. 4B, the cam 30*b* has a race surface 32*b* that is substantially V-shaped in cross section and the rollers 80*b* on the fingers 44 have substantially spherical shapes and are of corresponding size such that they seat and roll firmly in the race, contacting opposite side walls of the substantially V shaped race surface 32*b*, as shown. In FIG. 4C, the cam 30*c* has a race surface 32*c* that is substantially tapered on one side and the rollers 80*c* on the fingers 44 have a corresponding taper and size such that they seat and roll firmly in the substantially tapered race 32*c*, as shown. In FIG. 4D, the cam 30*d* has a race surface 32*d* that comprises an elongate raised area (e.g., a rail, hump or bead) and the rollers 80*d* have corresponding grooves or indentations formed on their surfaces such that they seat and roll firmly on the race surface 32*d*, as shown. In FIG. 4E, the cam 30*e* has a race surface 32*e* that is substantially flat and the fingers are maintained in positions such that they ride on the race surface 32*e*, as shown.

Operation of an individual fingers 44 of the pump device 10 may be more clearly understood with reference to FIGS. 6A and 6B. FIG. 6A shows a finger 44 of the device 10, aligned substantially parallel to the axis of rotation of cam 30 (the axis of rotation being represented by dashed line AR in FIG. 6A). Wall portions 12*a* and 12*b* of the housing 12 maintain positioning of the finger 44 over the cam surface 32 of such that the roller 50 of the finger 44 is seated within the concave cam race. The retraction spring 114 of the finger 44 extends through the aperture 126 of the housing 12 and may rest against aperture surface 126*a*. As shown, the distal end of the occlusion valve element 92 is in contact with, but causing no substantially compression of, the fluid filled tubing 50. The tubing 50 is being held in place against the platen surface 22 by means rib 63.

FIG. 6B shows the action of the finger 44 as it reciprocates toward the platen surface 22 as a cam lobe L passes beneath roller 80 causing occlusion valve element 92 to compress tubing 50 against the platen surface 22 and occluding fluid flow therethrough. The occlusion valve springs 96 functions to bias the occlusion valve element 92 to this extended position as restrained by the guide pins 102 through the apertures 104.

As shown in FIGS. 6A and 6B, the race of cam surface 32 is defined by a concavely curved transverse cross-section sized so that the roller 50 can be freely seated therein. Preferably, the cross section of the cam race has a radius that is somewhat larger than a radius of the roller 50, in order that the roller 50 contacts the cam surface 32 at a very small region of contact, theoretically, a point of contact. In other embodiments, the cam surface includes a substantially V-notch cross-sectional race, such that each of the rollers contacts the cam surface at two substantially opposing "points". Other configurations, such as a tapered cross sectional race, may alternatively be provided.

Figure 7:
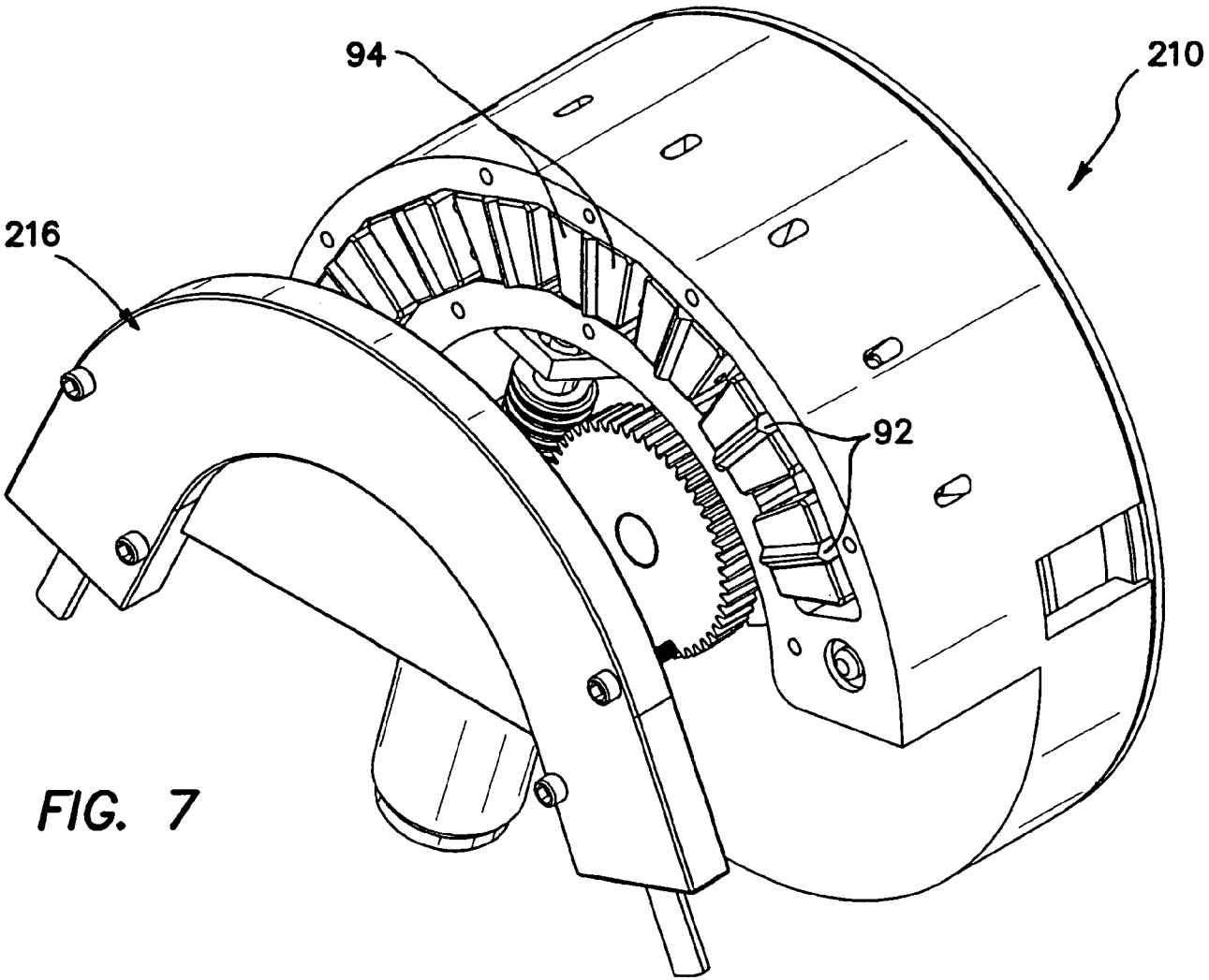
FIG. 7 is a perspective view of another embodiment of the invention.

FIG. 7 shows an alternative peristaltic pump device 210 of the invention with an integral platen and cassette assembly 216. This device 210 is substantially the same as device 10, with a primary difference being that device 210 includes no hinged door, latch or stop.

Figure 8:
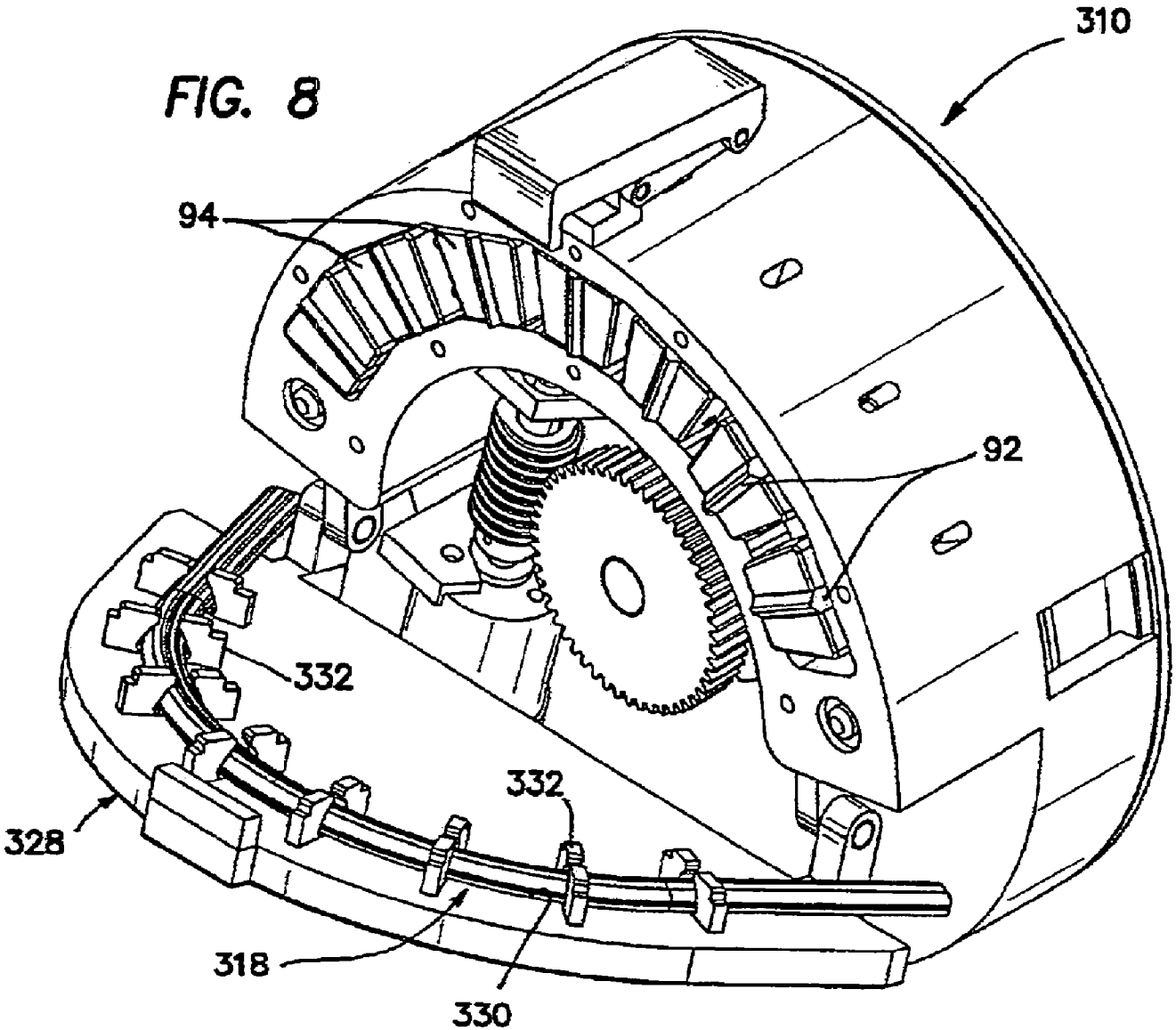
FIG. 8 is a perspective view of yet a further embodiment of a pumping device of the present invention.

FIG. 8 show another embodiment of a rotary axial peristaltic pump device 310 of the present invention with cassette tubing carrier structure 318 incorporated into a hinged door 328. For example, in this embodiment, a planar platen surface 330 and ribs or rib members 332 are incorporated into the door 328 as shown. In the same manner as described above with respect to device 10, the door 328 pivots between open and closed positions.

Figure 9A:
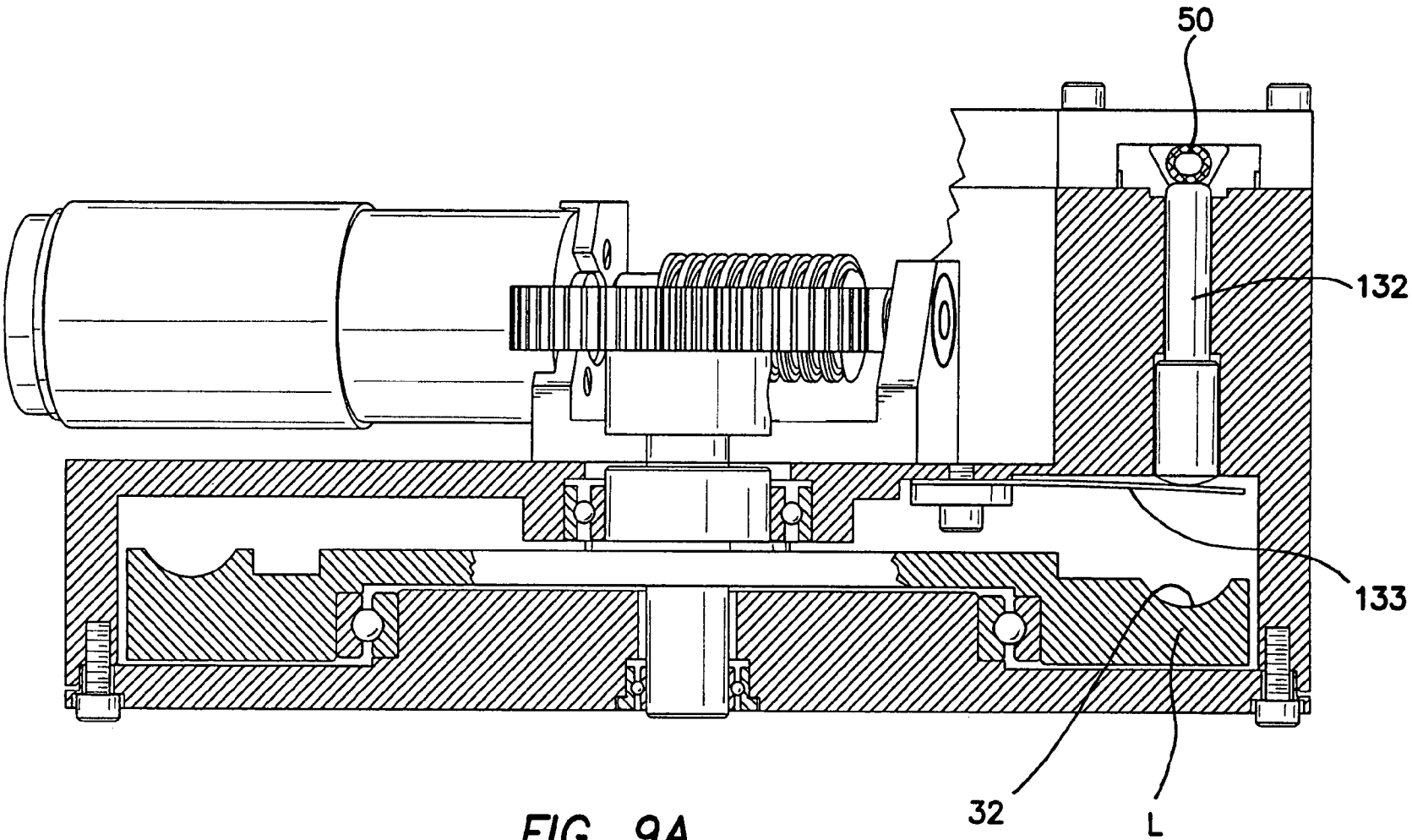
FIG. 9A is a sectional view through a portion of the pumping device of FIG. 1 showing an optional strain gage beam for determining the degree of tubing expansion, wherein the tubing adjacent to the strain gage is substantially expanded.
Figure 9B:
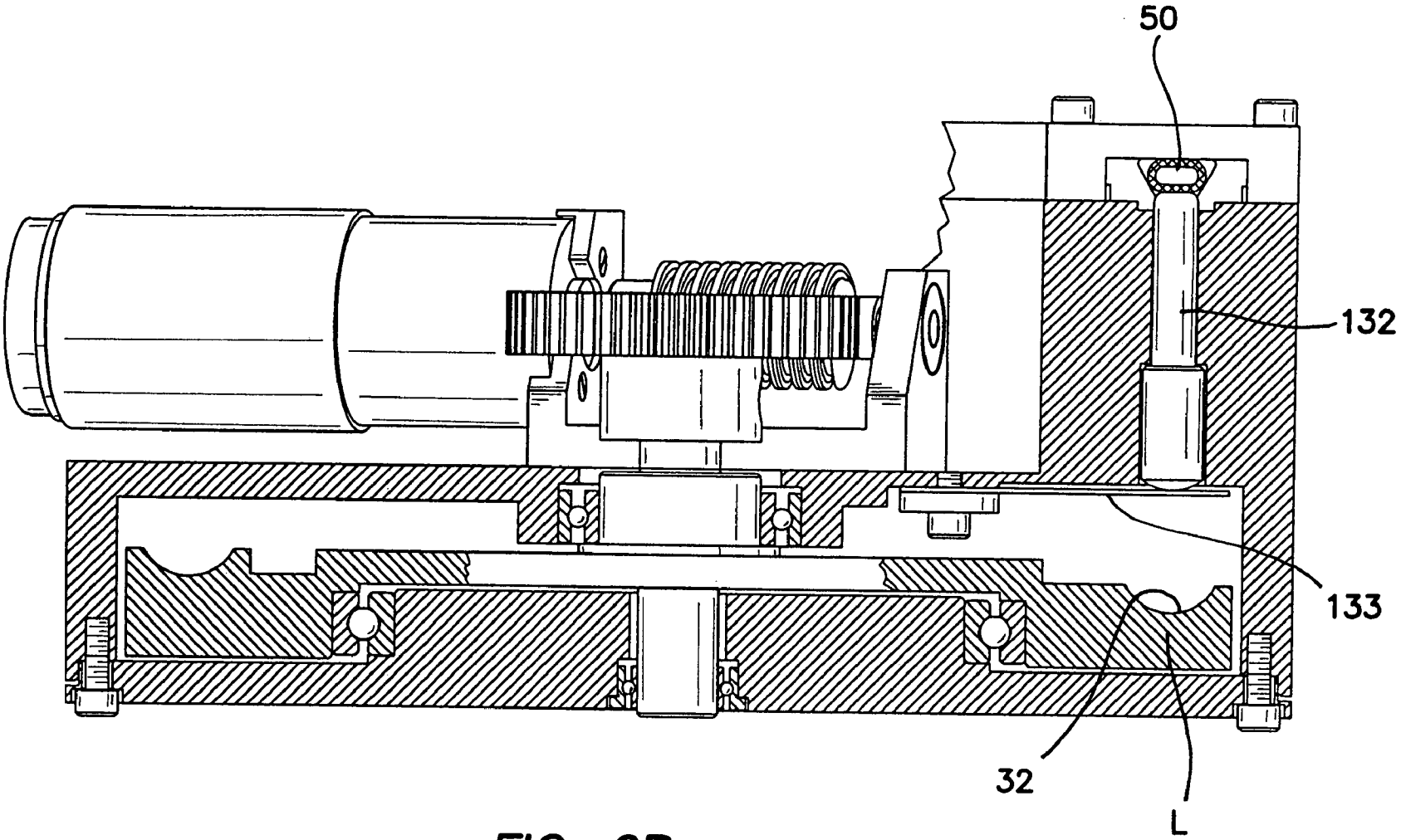
FIG. 9B is a sectional view through a portion of the pumping device of FIG. 1 showing an optional strain gage bean for determining the degree of tubing expansion, wherein the tubing adjacent to the strain gage is substantially non-expanded.

Optionally, as shown in FIGS. 1, 9A and 9B, pressure detection devices 132, 133 may be included in the device 10, one just prior to the first pump finger (inlet side) and the other following the last pump finger (outlet side). Alternatively or additionally, an apparatus for detecting the pressure in the tubing may be provided. The tubing 50 is partially compressed by the pressure detection device 132, 133 which exerts a reactive force against a preloaded strain gauge beam 133 having one end attached to the housing. Thus, the amount of deflection of the strain gage beam 133 varies directly with the amount of pressure within the tubing 50 at the location of that pressure detection device 132, 133. Any conventional strain gauge transducer may be used. More specifically, the strain gauge beam 133 operates in the following manner. As the pressure in the tubing 50 increases or decreases, the tubing 50 swells or contracts respectively against the fixed planar platen so as to cause the pressure detecting device 132, 133 to exert a different pressure against the strain gauge beam 133 and thereby change the strain gauge beam deflection. As is well established in the art, the electric signal measured from a strain gauge is proportional to the amount of deflection the strain gauge beam experiences. Moreover, calibrating the electric signal from the strain gauge allows a system to determine the amount of pressure in the tubing for the purpose of pressure reading and occlusion detection.

Referring to FIGS. 2 and 9B, as pumping occurs, fluid is drawn into the pump tubing 50 from the inlet side. If the inflow of fluid into the pump tubing 50 becomes obstructed, for example if an inlet or supply tube is kinked, or if the source of fluid become depleted, a decrease in pressure in the tubing 50 will occur causing the tubing 50 to collapse and lessen its force against the pressure detection device 132 in the inlet side, thereby causing the stain gauge beam 133 associated with that pressure detection device 132 to deflect towards the tubing 50 as seen in FIG. 9B. If the amount of deflection towards the tubing 50 exceeds a predetermined amount, a controller, computer or processor associated with the pumping device 10 may provide an inlet occlusion alarm or signal and/or may invoke some desired remedial measure such as automatic shut down of the pumping device 10. On the other hand, as seen in FIGS. 2 and 9A, as pumping occurs, fluid is pushed out of the outlet end of the pump tubing 50. If the outflow of fluid from tubing 50 becomes obstructed, for example if an outlet tube is blocked or pinched off outside of the pump, an increase in pressure in the pump tubing 50 will occur, thereby causing the tubing 50 to swell. Such swelling of the tubing 50 causes the pressure detection device 134 at the outlet end of the pump device 10 to cause the strain gage beam 133 associated with that pressure detection device 134 to deflect away from the tubing 50 as seen in FIG. 9A. If the amount of deflection away from the tubing 50 exceeds a predetermined amount, a controller, computer or processor associated with the pumping device 10 may provide an outlet occlusion alarm or signal and/or may invoke some desired remedial measure such as automatic shut down of the pumping device 10.

It is to be appreciated that the invention has been described hereabove with reference to certain examples or embodiments of the invention but that various additions, deletions, alterations and modifications may be made to those examples and embodiments without departing from the intended spirit and scope of the invention. For example, any element or attribute of one embodiment or example may be incorporated into or used with another embodiment or example, unless to do so would render the embodiment or example unsuitable for its intended use. Also, where the steps of a method or process are described, listed or claimed in a particular order, such steps may be performed in any other order unless to do so would render the embodiment or example un-novel, obvious to a person of ordinary skill in the relevant art or unsuitable for its intended use. All reasonable additions, deletions, modifications and alterations are to be considered equivalents of the described examples and embodiments and are to be included within the scope of the following claims.

What is claimed is:

1. A peristaltic pump device comprising:

a platen having a platen surface;

a tube positioned adjacent to the platen surface;

a cam that rotates about a rotational axis, said cam having a cam surface that is spaced apart from the platen surface;

a plurality of fingers, each finger having a first part nearer the cam and a second part nearer the tube and also having a torsion spring for urging the finger away from the tube and a longitudinal axis that is substantially parallel to the rotational axis of the cam, said fingers being in engagement with the cam surface such that, as the cam rotates about the rotational axis, the fingers will move axially back and forth, sequentially compressing the tube against the platen surface and thereby causing peristaltic movement of fluid through the tube; and a door that may be opened and closed to allow access to the tube, wherein the tube is mounted on or in a cassette and the door may be opened to gain access to allow removal of the cassette having the tube thereon or therein and replacement thereof with another cassette having another tube thereon or therein, and wherein at least one alignment surface is formed in the door, said alignment surface being configured to register with the cassette when the door is closed, thereby holding the cassette in a desired alignment, and wherein the platen surface is on an inner surface of the door and at least one indentation is formed in said platen surface such that the tube will be substantially juxtaposed to the platen surface when the door is closed.

2. A device according to claim 1 wherein the platen surface is substantially planar.

3. A device according to claim 1 wherein the cam surface includes a plurality of lobes.

4. A device according to claim 1 wherein each lobe of the cam comprises a wave in the cam surface, each such wave having a peak, the peak of each wave being closer to the platen surface than the remainder of the cam surface.

5. A device according to claim 1 further comprising a tube holder that holds the tubing adjacent to the platen surface.

6. A device according to claim 1 wherein each finger further comprises a second spring for urging the finger into contact with the tube.

7. A device according to claim 1 wherein the platen surface is substantially flat and further comprising a tube holder that holds the tube adjacent to the substantially flat platen surface.

8. A device according to claim 1 wherein the door is pivotally connected.

9. A device according to claim 1 wherein the platen surface is located on one side of the door.

10. A device according to claim 9 further comprising a tube holder that holds the tubing adjacent to the platen surface.

11. A device according to claim 10 wherein the tube holder comprises a plurality of tube-receiving notches within which the tube is received.

12. A device according to claim 11 wherein the platen surface is substantially flat and the tube holder holds the tube adjacent to the substantially flat platen surface.

13. A device according to claim 1 further comprising a housing with apertures for receiving an end of each first spring.

14. A device according to claim 1 further comprising a tube cassette which includes said tube.

15. A device according to claim 14 wherein the tube cassette may be removed and replaced by another tube cassette.

16. A device according to claim 14 wherein the tube cassette comprises a substantially rigid structure that holds the tube in a desired configuration.

17. A device according to claim 16 wherein the cassette structure holds the tube in a substantially accurate configuration.

18. A peristaltic pump device comprising:

a platen having a platen surface;

a tube positioned adjacent to the platen surface, wherein the tube is mounted on or in a cassette and further comprising a door that may be opened and closed to gain access to the tube and the cassette for replacement thereof with another cassette having another tube thereon or therein;

a cam that rotates about a rotational axis, said cam having a cam surface that is spaced apart from the platen surface; and a plurality of fingers, each finger having a longitudinal axis that is substantially parallel to the rotational axis of the cam, said fingers being in engagement with the cam surface such that, as the cam rotates about the rotational axis, the fingers will move axially back and forth, sequentially compressing the tube against the platen surface and thereby causing peristaltic movement of fluid through the tube, wherein the cassette comprises a plurality of strut members through which the tube extends and wherein a plurality of strut member receiving indentations are received in the platen surface such that, when the door is closed, the strut members will be received in the strut member receiving indentations and the tube will be substantially juxtaposed with the platen surface.

19. A device according to claim 18 wherein at least one of the fingers further comprises a first spring for retracting that finger away from the platen surface.

20. A device according to claim 19 wherein the finger further comprises a second spring for urging the finger into contact with the platen surface.

21. A device according to claim 20 further comprising a mechanism for limiting movement of the second spring.

22. A device according to claim 19 wherein the at least one finger is coupled to the cam in a way that would not cause the cam to pull that finger away from the platen surface during a portion of the pumping cycle.

23. A device according to claim 18 wherein each finger comprises a first part away from the platen and a second part near the platen, the first and second parts moveable with respect to each other.

* * * * *